US007540123B1

(12) United States Patent
Semmes

(10) Patent No.: US 7,540,123 B1
(45) **Date of Patent: *Jun. 2, 2009**

(54) BASE FOR ROOFTOP AIR CONDITIONING UNITS

(76) Inventor: Thomas Middleton Semmes, 17276 SE. Parkers Dr., Gladstone, OR (US) 97027

( * ) Notice: Subject to any disclaimer, the term of this patent is extended or adjusted under 35 U.S.C. 154(b) by 217 days.

This patent is subject to a terminal disclaimer.

(21) Appl. No.: 11/371,779

(22) Filed: Mar. 9, 2006

(51) Int. Cl.
*E04C 2/54* (2006.01)
*E04C 2/32* (2006.01)
*E04C 2/34* (2006.01)

(52) U.S. Cl. ..... 52/783.19; 52/783.14; 52/792.1; 52/794.1; 52/795.1

(58) Field of Classification Search ..... 52/783.11, 52/783.14, 783.19, 784.15, 784.16, 792.1, 52/794.1, 795.1
See application file for complete search history.

(56) References Cited

U.S. PATENT DOCUMENTS

| | | | | |
|---|---|---|---|---|
| 3,274,739 | A * | 9/1966 | Gregoire | 52/155 |
| 3,733,232 | A * | 5/1973 | Payne | 156/79 |
| 5,661,937 | A * | 9/1997 | Doppler et al. | 52/410 |
| 6,321,504 | B1 * | 11/2001 | Svensson | 52/737.1 |
| 2005/0066609 | A1 * | 3/2005 | Olah | 52/633 |

* cited by examiner

*Primary Examiner*—Brian E. Glessner
*Assistant Examiner*—Branon C Painter
(74) *Attorney, Agent, or Firm*—Mark S. Hubert

(57) ABSTRACT

The present invention relates to improved base for a large, commercial rooftop air conditioning (A/C) unit. The base is assembled from a series of interconnectable, corrugated floor panels having smooth bottom planar surfaces that may directly be mounted atop existing rooftop A/C unit curbs. The panels are each constructed from metal or steel, concave formed linear members that reside coplanar and are separated by a foam core. There is a base to wall panel connecting rail that simplifies the attachment of the A/c unit's side walls.

2 Claims, 7 Drawing Sheets

BASE FOR ROOFTOP AIR CONDITIONING UNITS

FIELD OF THE INVENTION

The present invention relates to an improved base for a large, commercial rooftop air conditioning (A/C) unit. More specifically, it relates to a new paneled floor system that serves as the base for a large rooftop A/C unit that is adaptable for installation onto an existing building roof curb. This design allows for ease in retrofitting new energy efficient A/C units onto older buildings.

BACKGROUND

Commercial rooftop A/C units gained huge popularity and growth in the 1980's. The technology of that time only allowed for a 20 year life span. This will necessitate the replacement of many of the aging, larger commercial rooftop A/C units presently in use in the next decade. This replacement operation can be substantially simplified with the present invention.

Commercial buildings generally have flat roofs upon which the building A/C units are mounted. A continuous curb, or rectangular frame enclosure is mounted on the roof, around a roof opening, so as to form a small dam. The curb is higher than the rooftop water level preventing water in leakage through the roof opening. This curb is integrated into the roofing system and roofing materials of the building, and is custom built for the specific dimensions of the A/C unit to be installed. The A/C unit rests on top of the curb and is mounted to the curb. New A/C units are generally not compatible with the older curbs, and while curb adapters can be designed, built and installed, these add an additional height to the overall unit. This can add additional roof weight, increase the wind loads and destroy the aesthetics of the original layout as most existing units are located out of line of sight or are placed behind visual screening apparatus.

The present invention uses a set of corrugated floor panels that interlock to form a base or floor that has a smooth, planar bottom surface. Since the major manufactures of rooftop A/C units make these units with similar dimensions, the floor panels can be made slightly longer than largest A/C unit's width, so that the base's bottom surface can rest directly on a plethora of differently sized curbs. There will be a minimal amount of cantilever over the existing curbs, but in this way, no curb adapter is necessary, and further, there is no need for various bases in differing lengths as this may be adjusted with the number of interlocking panels.

Such an innovative A/C base as the present invention provides, overcomes the pitfalls of the prior art and is a simple solution that enables the ease of an A/C unit retrofit by any manufacturer atop of any other manufacturer's rooftop curb.

SUMMARY OF THE INVENTION

The general purpose of the present invention, which will be described subsequently in greater detail, is to provide a simple, length adjustable rooftop A/C base for retrofitting new A/C units onto existing rooftop curbs.

It has many of the advantages mentioned heretofore and many novel features that result in a new, A/C unit base design which is not anticipated, rendered obvious, suggested, or even implied by any of the prior art, either alone or in any combination thereof.

In accordance with the invention, an object of the present invention is to provide an improved rooftop A/C base that will eliminate the need for a curb adapter.

It is a further object of this invention to provide an improved rooftop A/C base that is simple and economical to construct.

It is a final object of the present invention to provide an improved rooftop A/C base design that will minimize the height, weight and wind load of a retrofitted rooftop commercial A/C unit.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
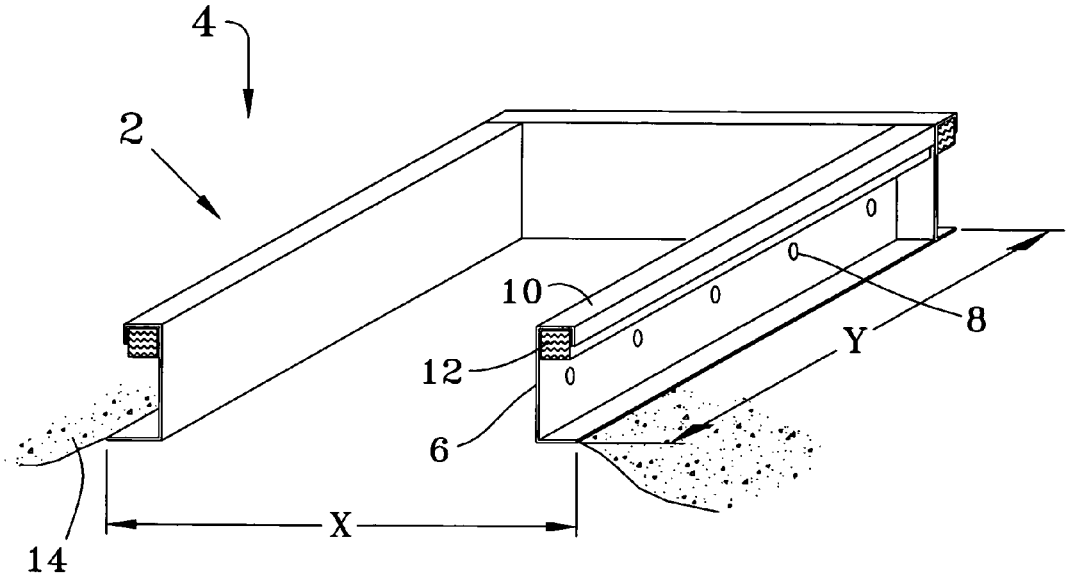
FIG. 1 is a perspective cross section of a conventional A/C rooftop unit curb.

The present invention relates to an improved rooftop A/C base, utilizing a series of interconnectable, corrugated floor panels that have a smooth, planar bottom surface that are adapted for installation atop of most existing rooftop A/C curbs.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings.

The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The design of a standard commercial rooftop A/C unit base is well known in the industry. It is the unique configuration and design of such a base that is the subject of this invention.

Looking at FIG. 1, a conventional curb 2 can be seen atop a flat roof 4. Curb 2 is a linear steel channel 6 that has been mechanically affixed to the roof 4 by some form of mechanical fastener 8 such as a bolt or screw. The top lip 10 of the channel has a furring strip mechanically affixed to its underside. The furring strip 12 serves as a wooden surface to accommodate conventional building methods (such as nailing or stapling) for affixing roofing 14, water barrier materials or the such. Steel formed or structurally bent channels are used because they are strong, lightweight and can be made to offer a broad support surface on their top lip 10 for the A/C unit to rest upon.

Figure 2:
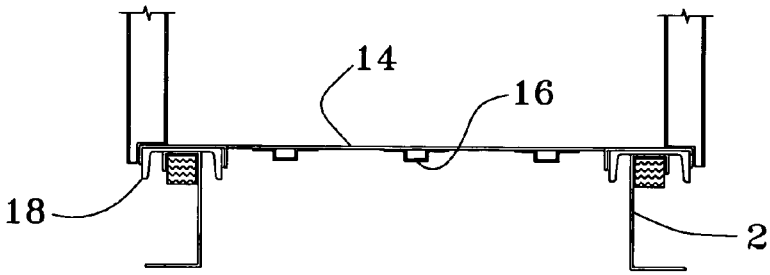
FIG. 2 is a cross section of a conventional A/C rooftop unit base mounted onto a curb.

Looking at FIG. 2, a conventional A/C rooftop unit base 14 is illustrated mounted onto a conventional curb 2. It can be seen that the conventional base 14 has a flat, planar upper surface and is strengthened by ribs 16 on its lower surface. The load carrying members 18 of the conventional base 14 are centered atop of curb 2. Specifically, the curb 2 is mated by design to fit the dimensions of conventional base 14.

Figure 3:
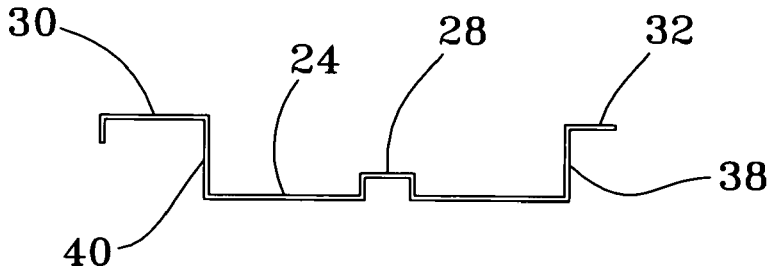
FIG. 3 is an end cross sectional view of the floor panel top plate.
Figure 4:
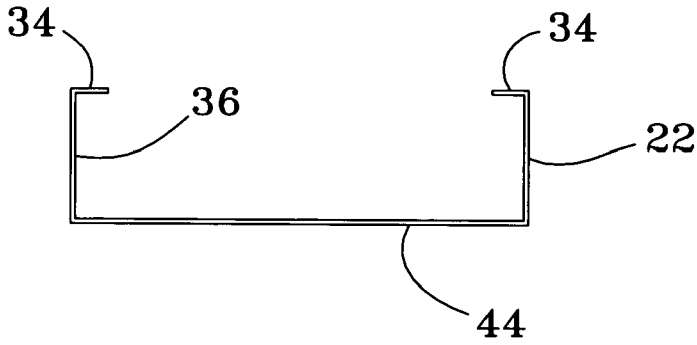
FIG. 4 is an end cross sectional view of the floor panel bottom plate.
Figure 5:
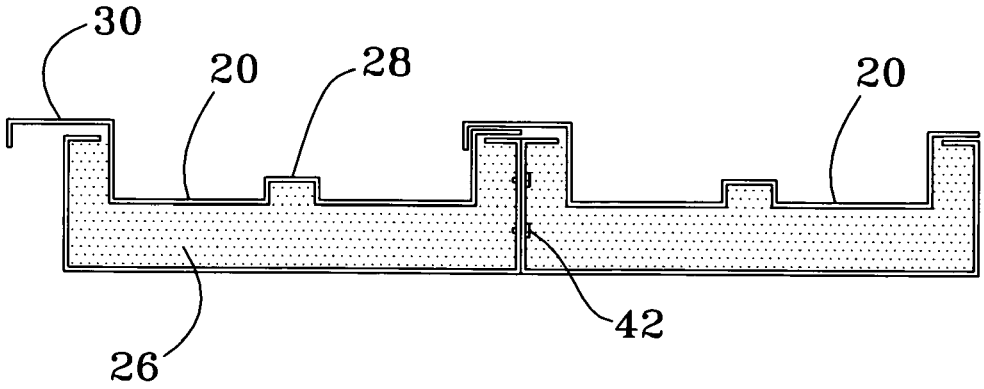
FIG. 5 is an end cross sectional view of two assembled floor panels that have been connected and filled with foam insulation.

Looking at FIGS. 3, 4 and 5 the general arrangement of a floor panel 20 and the manner of joining two or more floor panels can be best seen. Floor panel 20 is a linear member formed from a longitudinally symmetrical "C" channel 22, and a corrugated top panel 24, that are adhered together after the injection of an expanding, adhesive foam core 26 between these panels. Top panel 24 has a concave configuration with two flanges extending normally outward from the top linear edge of its parallel sides 38. Channel 22 has a concave configuration with two substantially similar flanges 34 extending internally and normal from the top linear edge of its parallel sides 36. The concavity of top panel 24 resides inside the concavity of "C" channel 22. Insulating adhesive foam 26 holds channel 22 and top panel 24 together. Top panel 24 is not symmetrical about its longitudinal axis. It has a depth of corrugation and a raised profile 28 along its longitudinal axis to impart strength and rigidity. First side 38 of top panel 24 has a flange 32 extending outward and normal. The opposing second side 40 of top panel 24 has a cap flange 30 also extending outward and normal but is formed into an interlocking cap that is dimensioned so as to reside atop of first flange 32 of an adjacently positioned floor panel 20. Adjacent floor panels 20 are connected by mechanical fasteners 42 that pass through abutting sides 36. These fasteners 42 are applied before panel 20 is fully assembled and foam 26 installed. Although not illustrated, it is known that the method of mechanical fastening by crimping together the metal of adjacent panels is an acceptable, commonly used alternative to the use of nuts and bolts, screws, rivets, pins etc.

Figure 6:
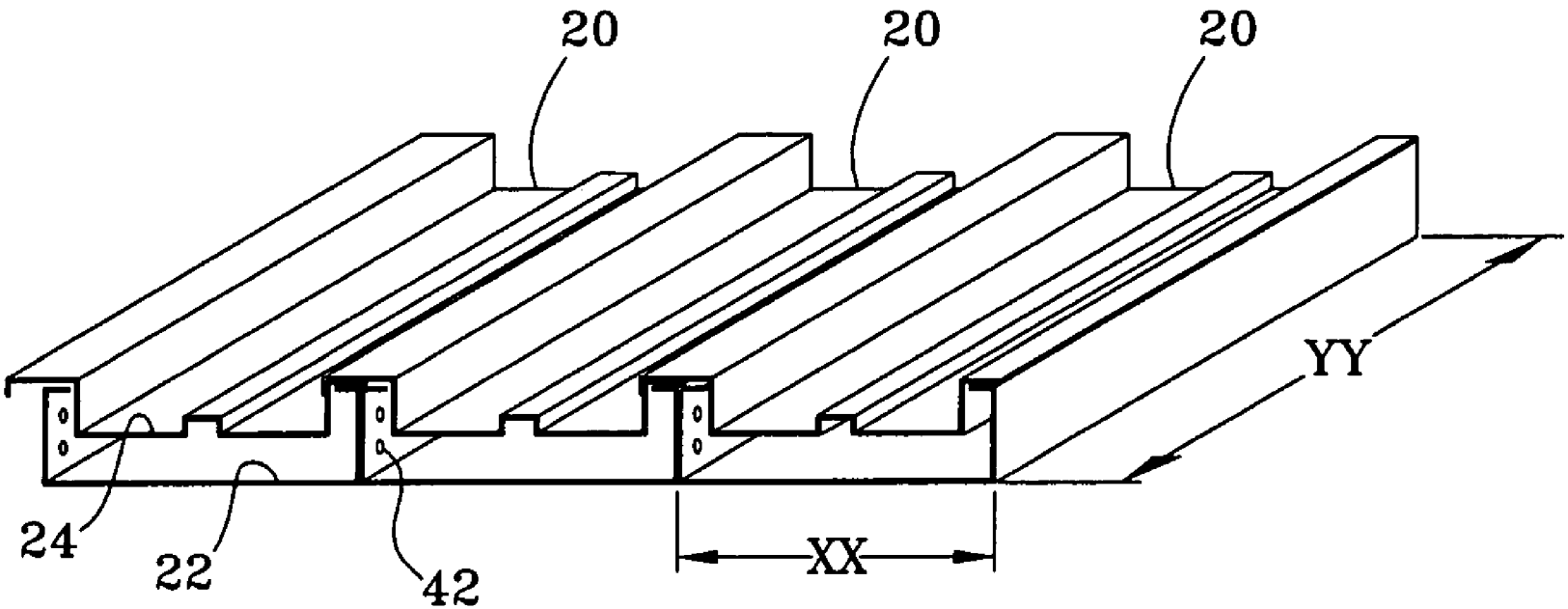
FIG. 6 is a perspective view of three connected floor panels before foam insulation.
Figure 7:
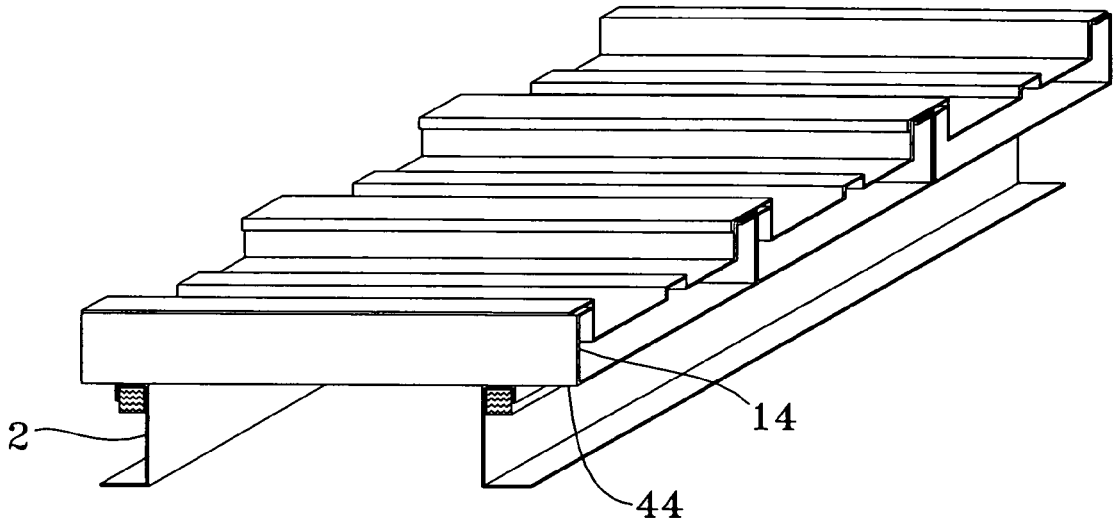
FIG. 7 is an end cross sectional view of a modified base atop a curb narrower than the rooftop A/C unit.
Figure 8:
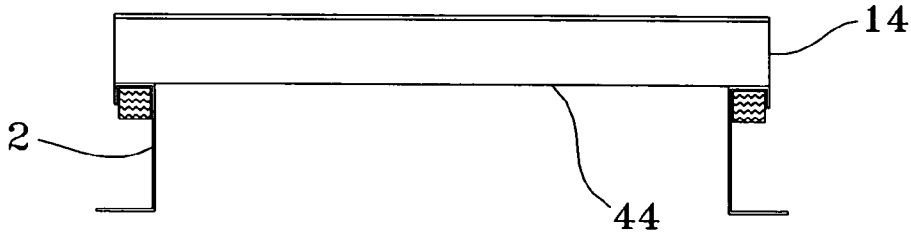
FIG. 8 is an end cross sectional view of a base atop a curb of the maximum width to accommodate the rooftop A/C unit.

FIG. 6 shows a perspective side view of three connected floor panels 20 prior to the injection of insulating foam. It is a notable distinction between the base of the present invention and conventional rooftop A/C unit bases, that base 14 has a smooth, planar bottom surface 44 and a corrugated upper surface which is shaped into folds or parallel and alternating ridges and grooves. This design is an inversion of the conventional bases, which have smooth, planar upper surfaces and ribbed or corrugated bottom surfaces, as can be seen in FIG. 2.

FIGS. 1 and 7-10 taken together, best illustrate the use and advantages of this rooftop A/C base 14. Curbs, due to the necessary linear alignment of components, are of a rectangular geometry having a width designated as X in FIG. 1, and a length designated as Y in FIG. 1 wherein the length Y is always the longest of these two dimensions. Panel 20 has a width designated as XX in FIG. 6, and a length designated as YY in FIG. 6 wherein the length YY is always the longest of these two dimensions. The panels 20 are always placed relative to the curb 2 such that the panel length YY is perpendicular to the curb length Y. In this manner the structural strength of the panel's parallel and alternating ridges and grooves (corrugation) can offer the most rigidity to the base 14. Since the base 14 has a smooth bottom 44, the base width (which is panel length XX) is not dependent upon the curb width X as can be seen by the placement of base 14 atop the curbs 2 of FIGS. 7 and 8. New, retrofit bases can be mounted atop existing curbs without strict dimensional mating, provided that the curb width X does not exceed the panel length YY and first panel clip width combined. (The first panel clip 56 is discussed herein.) Since the dimensional sizes of the bases of the major manufacturers vary only slightly, the panel length YY is selected to exceed most commonly utilized curb widths X. In the case of a curb with a width x that exceeds the panel length YY, a first panel clip 56 may be used to extend the base width/panel length.

The panel interconnection system is not designed to be strong enough to allow panels 20 to carry loads if there is not some load bearing member in contact with that panel's bottom 44.

In contrast, the base length may be considerably shorter than the curb length Y. In that case, cover panels may be installed atop the curb 2 that prevent the ingress of water to the interior bounded area of curb 2.

Stated differently, the base width is equal to or greater than the curb width X, while the base length can be shorter than, equal to, or longer than the curb length Y.

Figure 9:
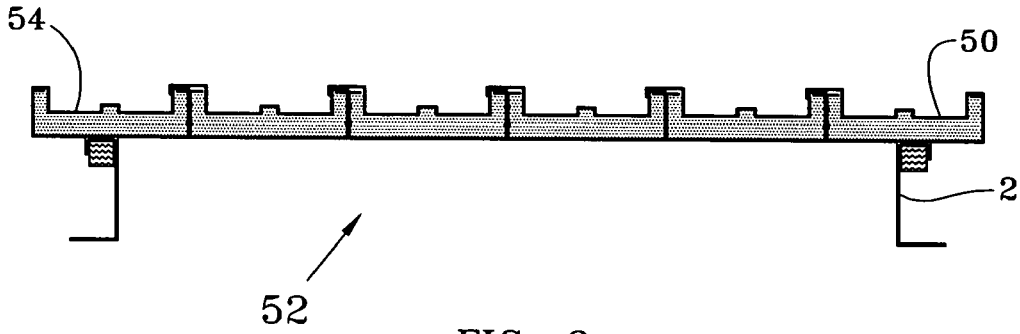
FIG. 9 is a side cross sectional view of a base atop a curb unit shorter than the length of the rooftop A/C unit.
Figure 10:
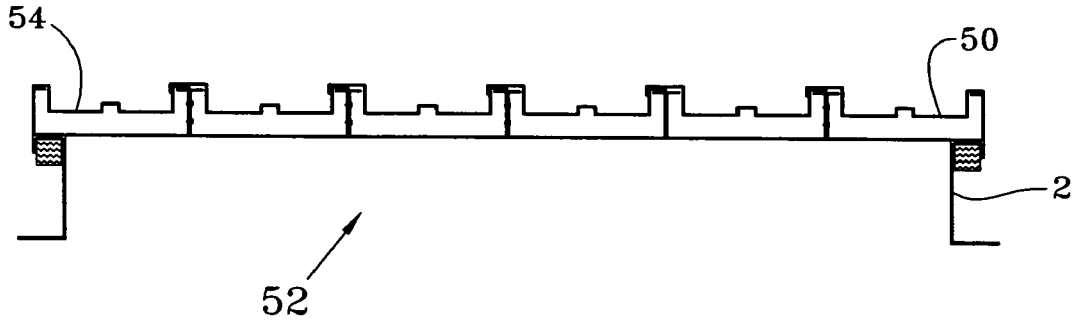
FIG. 10 is a side cross sectional view of a base atop a curb unit of the maximum length to accommodate the rooftop A/C unit.

Contrasting FIG. 6 with FIGS. 9 and 10 it can be seen that in a complete base 52 the end panel 54 has its cap flange 30 trimmed so as to have the flange edge end not extend beyond the side 36 of channel 22.

Figure 11:
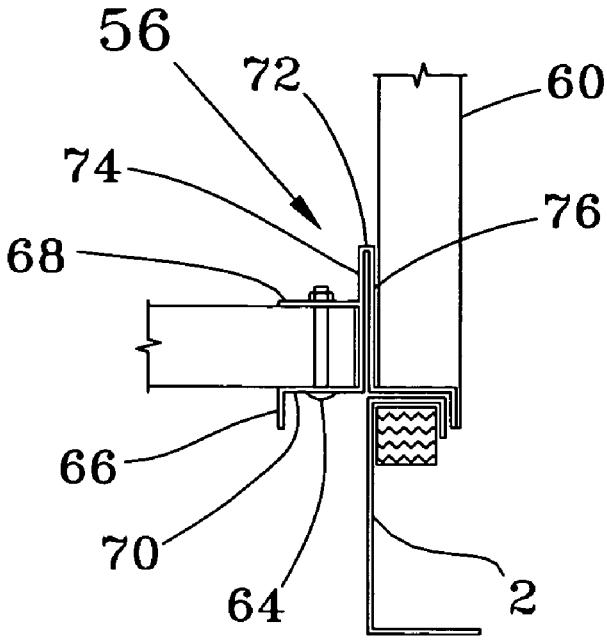
FIG. 11 is an end cross sectional view of the base and first wall panel clip.
Figure 12:
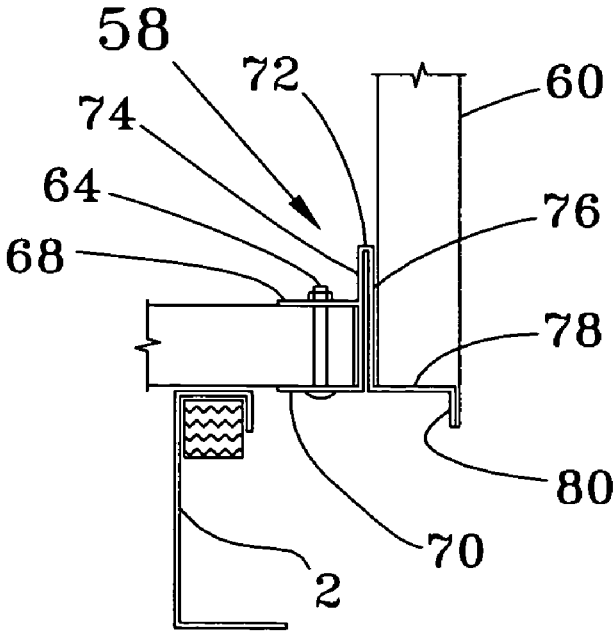
FIG. 12 is an end cross sectional view of the base and second wall panel clip.

Looking at FIGS. 11 and 12 the first embodiment wall panel clip 56 and second embodiment wall panel clip 58 can be seen in their differing applications. These clips differ in their ability to carry a load. First clip 56 is stronger than second clip 58 but because first clip 56 has a strengthening rib 66, there are physical limitations as to the location of curb 2 underneath. Other than the elimination of rib 66 on second panel clip 58, the clips are substantially identical. These clips are used to attach the unit walls 60 to the unit base 14. As discussed above, if the curb width X exceeds the panel length YY, first panel clip 56 may be used to widen the base 14 by the dimension of the clip 56 as well as attach the unit walls 60. When the panel length YY is longer than the curb width X, second clip 58 may be used to secure the unit walls 60 to the unit base.

First panel clip 56 has an upper plate 68 and a lower plate 70 which projects normally from the first side 74 of folded plate 72 so as to be held in a parallel planar configuration. The spacing between upper plate 68 and lower plate 70 is adapted to accommodate the thickness of a panel 20. Wall support plate 78 extends normally from the second side 76 of folded plate 72 so as to be held in a parallel planar configuration with upper plate 68 but sharing a common plane with lower plate 70. Unit wall 60 resides on the upper surface of wall support plate 78 while the lower surface of wall support plate 78 resides atop curb 2. A wall sealing flange 80 extends normally and downward from wall support plate 78 to allow a moisture proof seal with unit wall 60. Strengthening rib 66 projects normally and downward from lower plate 70. This rib 66 serves the purpose of adding strength to lower plate 70 thereby preventing deformation of plate 70 by panels 20 that transmit heavy loads onto clip 56, and maintaining the planar alignment of all panels 20.

In the case of second panel clip 58, while unit wall 60 resides on the upper surface of wall support plate 78, the lower surface of wall support plate 78 does not reside atop curb 2. Since it is used where the bottom surface 44 of panel 20 resides atop curb 2, there is no need for the strengthening rib 66 as the alignment of panels 20 is not an issue.

Figure 13:
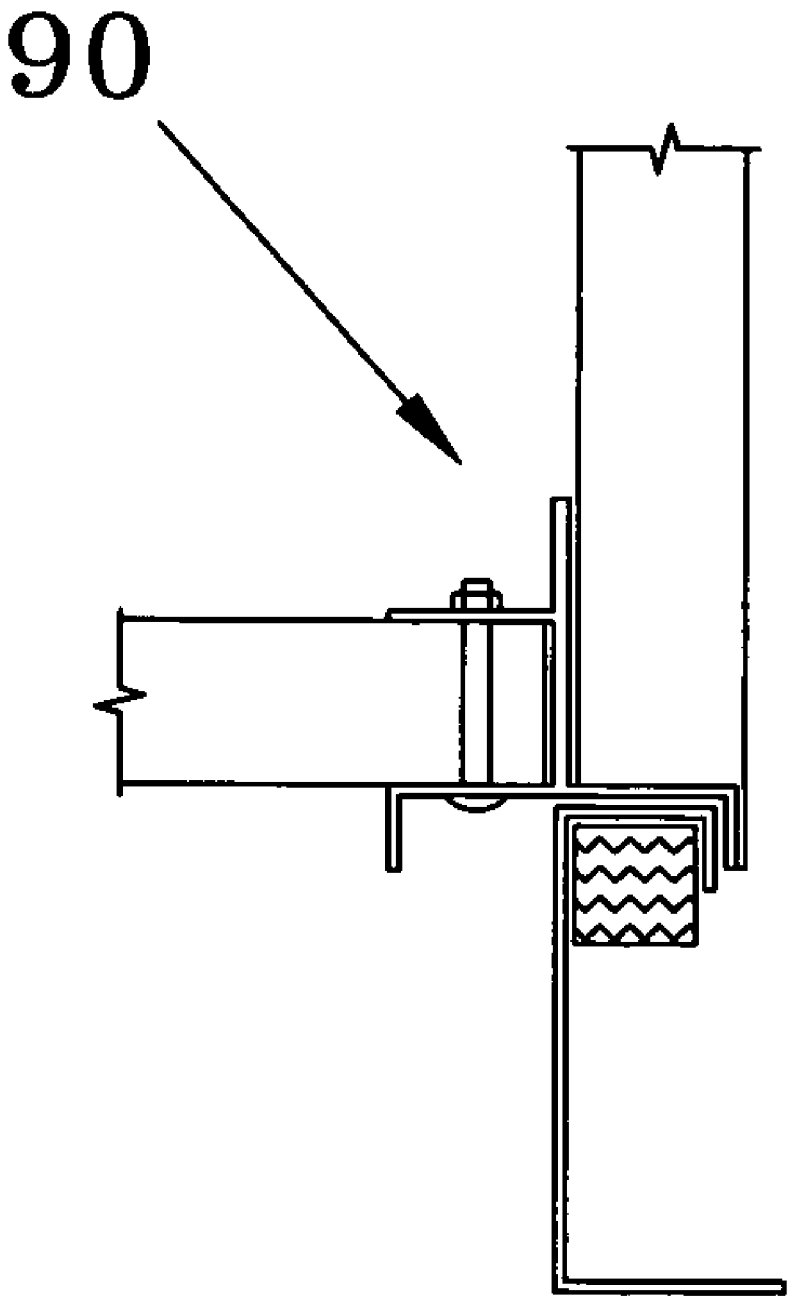
FIG. 13 is a cross sectional view of the base and first wall panel clip formed by extrusion.

Both first panel clip 56 and second panel clip 58 are mechanically fastened to panel 20 by a suitable fastener 64, such as a nut and bolt assembly, that passes through the panel 20 and clip, normal to the longitudinal axis of the panel 20. This fastening arrangement is identical whether along the panel length YY or panel width XX. These clips may be made as shorter units wherein multiple clips will be needed per side, however, the preferred embodiment clips are sized to be the approximate length of each side of the base 14 such that only four clips are used in a standard, rectangular base 14. FIG. 13 illustrates a solid extruded version base and first wall panel clip 90.

The above description will enable any person skilled in the art to make and use this invention. It also sets forth the best modes for carrying out this invention. There are numerous variations and modifications thereof that will also be apparent to others skilled in the art, now that the general principles of this invention have been disclosed.

Having thus described the invention, what is claimed as new and desired to be secured by Letters Patent is as follows:

1. A rooftop air conditioning unit floor system comprising at least two panels mechanically connected so as to reside adjacent and parallel, wherein said panels are comprised of a first, upper, concave, surface corrugated, linear steel member that resides atop a second, "C" shaped, concave, linear steel member such that said upper member's concavity resides within said lower member's concavity so as to form a void between said members that is filled with an adhesive and structural strengthening polymer foam, and wherein said mechanical connection of said panels is accomplished by a bolting arrangement between said adjacent second linear steel members, and wherein said first member is comprised of an upper corrugated plate having a first side of a first height projecting normally from said plate and a second side of a second height extending normally from said plate such that said first and second sides are congruent and parallel to each other, and wherein said first side has an "L" shape configured cap plate extending normally therefrom, and wherein said second side has a top plate extending normally therefrom, and wherein said first side's height exceeds said second side's height such that said L shaped cap plate resides atop of said top plate on said adjacent and parallel connected panels, and wherein said second, linear steel member is a linear plate with a first side and a second side extending normally therefrom so as to form a concave "C" configuration wherein said first side has a first upper flange and said second side has a second upper flange and wherein said cap plate of said first panel resides atop said first upper flange of said first panel and said top plate of an adjacent panel and said top plate of said first panel resides atop said second upper flange of said first panel, and further comprising at least one bolting arrangement for connecting the sides of adjacent said panels, and further comprising a steel panel clip adapted to secure and support a wall panel normal to said floor system wherein said clip has an upper rail and a lower L shaped rail each held in parallel configuration and extending normally from a first side of a side rail that has a wall support plate extending normally from a second side thereof and a wall sealing flange extending normally and downward from said wall support plate such that said wall support plate and said sealing flange form an exterior moisture proof seal with an exterior surface of a wall having a matingly configured outer lip that overlaps and is adjacent to said sealing flange when said wall resides atop of said wall support plate, and wherein said upper rail extends normally from a central location on said first side of said side rail so as to form said upper lip to form an interior moisture proof seal with an inside surface of said wall.

2. The rooftop air conditioning unit floor system of claim 1 wherein said clip is mechanically affixed to said wall panel by a mechanical fastener selected from the set of mechanical fasteners consisting of screws, nuts and bolts, and rivets and pins.

* * * * *